US008181895B2

(12) United States Patent
Kuvaja et al.

(10) Patent No.: US 8,181,895 B2
(45) Date of Patent: May 22, 2012

(54) WOBBLE STROKE ADJUSTMENT OF A CONE CRUSHER

(75) Inventors: Kari Kuvaja, Tampere (FI); Aki Lautala, Tampere (FI)

(73) Assignee: Metso Minerals Inc., Helsinki (FI)

( * ) Notice: Subject to any disclaimer, the term of this patent is extended or adjusted under 35 U.S.C. 154(b) by 92 days.

(21) Appl. No.: 12/865,896

(22) PCT Filed: Feb. 14, 2008

(86) PCT No.: PCT/FI2008/050063

§ 371 (c)(1),
(2), (4) Date: Aug. 25, 2010

(87) PCT Pub. No.: WO2009/101237

PCT Pub. Date: Aug. 20, 2009

(65) Prior Publication Data

US 2011/0095110 A1 Apr. 28, 2011

(51) Int. Cl.
*B02C 2/00* (2006.01)

(52) U.S. Cl. ..... 241/30; 241/207

(58) Field of Classification Search ..... 241/27, 241/30, 207–216

See application file for complete search history.

(56) References Cited

U.S. PATENT DOCUMENTS

| | | | |
|---|---|---|---|
| 5,312,053 | A | 5/1994 | Ganser, IV |
| 5,718,391 | A | 2/1998 | Musil |
| 6,213,418 | B1 | 4/2001 | Gabriel et al. |

FOREIGN PATENT DOCUMENTS

| | | | |
|---|---|---|---|
| EP | 1 736 243 | A1 | 12/2006 |
| WO | WO 00/78457 | A1 | 12/2000 |

OTHER PUBLICATIONS

International Search Report for International Application No. PCT/FI2008/050063, mailed on Nov. 17, 2008.

*Primary Examiner* — Mark Rosenbaum
(74) *Attorney, Agent, or Firm* — Oliff & Berridge, PLC

(57) ABSTRACT

A crusher comprising at least a main shaft having an axial line and being mounted on the inner frame of the crusher, an eccentric comprising at least a first eccentric bushing and a second eccentric bushing, a first crushing blade, and a second crushing blade. The first crushing blade is fitted to move along an eccentric path, which path can be adjusted by changing the mutual position of the first eccentric bushing and the second eccentric bushing of the eccentric. The second eccentric bushing comprises a gear transmission for rotating the eccentric, and the crusher comprises adjusting means for changing the mutual position of the gear transmission of the first eccentric bushing and the gear transmission of the second eccentric bushing.

13 Claims, 8 Drawing Sheets

WOBBLE STROKE ADJUSTMENT OF A CONE CRUSHER

FIELD OF THE INVENTION

The invention relates to crushers, particularly cone crushers. More precisely, the invention relates to a crusher and a crushing plant, as well as a method and a computer software product for adjusting the stroke of a crusher.

BACKGROUND OF THE INVENTION

A typical cone crusher comprises a frame provided with a main shaft and an outer crushing blade. A conical inner crushing blade is fitted on the main shaft and is movable on the main shaft with respect to the outer crushing blade so that a forced stroke is produced in the crushing chamber between the crushing blades.

In crushers of prior art, it is possible to change the stroke by changing the eccentricity of the path of the crushing cone. For example, publication U.S. Pat. No. 6,213,418 discloses a crusher, in which the eccentricity of the path is affected by changing the mutual positions of the outer and inner cylinders on the eccentric shaft. In this arrangement, the crusher must be disassembled for an adjustment, for which reason the adjustment takes time.

Publication WO 00/78457 discloses a crusher in which the stroke of the first crushing blade can be adjusted during the use of the crusher (i.e. without disassembling the crusher). In order to make this possible the eccentric shaft of the crusher has been constituted of inner eccentric shaft and outer eccentric shaft. The inner eccentric shaft is inside the outer eccentric shaft and these eccentric shafts are arranged to be turnable in respect of each other to change the amount of eccentricity of the eccentric shaft and the eccentric path of the main shaft. The mutual movement of the first and second eccentric shafts is accomplished by gear transmissions comprising a first cog wheel attached to the outer eccentric shaft and second cog wheel attached to the inner eccentric shaft, and a turning mechanism for turning the first cog wheel and the second cog wheel in respect of each other, in all embodiments of the crusher described in this publication the main shaft of the crusher is supported (in horizontal direction) by the inner and outer eccentric shafts being around the lower part of the main shaft and being supported by bearings fitted between the lower part of the frame of the crusher and the outer eccentric shaft. The first crushing blade is attached in all embodiments to the main shaft to the upper part of the main shaft so that the eccentric shaft leaves below (outside) the first crushing blade. It is not so great disadvantage in case of the crusher being provided supporting bearings at two points i.e. in the lower end and the upper end of the main shaft. However in such crushers having no upper supporting bearing for the main shaft it is more disadvantageous since forces formed by material to be crushed cause greater bending moments longer the distance between the bearings of the main shaft and the upper end of the first crushing blade. In addition in all type of crushers with this kind of construction increases the height of the crusher and thus makes it heavier and more space consuming.

BRIEF SUMMARY OF THE INVENTION

It is an aim of the solution according to the invention to eliminate drawbacks and faults of the above-presented solutions of prior art.

To achieve this aim, the apparatus according to the invention is primarily characterized in what will be presented in the independent claim 1. The crushing plant according to the invention is primarily characterized in what will be presented in the independent claim 8. The method according to the invention is, in turn, primarily characterized in what will be presented in the independent claim 10. The computer software product according to the invention is primarily characterized in what will be presented in the independent claim 12. The other, dependent claims will present some preferred embodiments of the invention.

The basic idea of the invention is that the adjustment of the crusher can be made advantageously during the operation, without disassembling the crusher and that adjusting means needed for carrying out the adjustment can be accomplished such that distance between the lower supporting bearings of the main shaft and the upper end of the first crushing blade and/or main shaft become smaller than in crushers according to prior art, e.g. in crusher of publication WO 00/78457.

The crusher according to the invention comprises at least a main shaft, an eccentric shaft, a first crushing blade, a second crushing blade, as well as adjusting means for adjusting the eccentric path of the eccentric shaft. In the crusher according to the invention, the main shaft is mounted on the lower frame of the crusher. The eccentric shaft comprises at least a first bushing (axial cylinder) and a second bushing, of which the second bushing is inside the first bushing. The first bushing comprises a gear transmission for rotating the eccentric shaft. The first crushing blade is fitted to move along an eccentric path, which path can be adjusted by changing the mutual position of the first bushing and the second bushing on the eccentric shaft. The second bushing also comprises a gear transmission for rotating the eccentric shaft. The crusher comprises adjusting means for changing the mutual position of the gear transmission of the first bushing and the gear transmission of the second bushing and thus for adjusting the eccentric path of the eccentric shaft. Further, in the crusher according to the invention the eccentric shaft is fitted at least partly in to the second crushing blade.

In one embodiment, the first eccentric bushing comprises a hole and the second eccentric bushing comprises a hole, and the main shaft with an axial line is fitted in the hole of the second eccentric bushing. In an advantageous embodiment, the direction of the hole in the first eccentric bushing deviates from the axial line of the main shaft; in other words, the direction of the hole is not parallel to the axial line.

In one embodiment, the outer shell and the inner shell of the first bushing are not parallel to each other, for adjusting the inclination of the first crushing blade by changing the mutual position of the first bushing and the second bushing. Herein below, the point of intersection between the central line of the main shaft and the central line of the first crushing blade will be called a pivot point.

The holes and shells of the eccentric bushings can be provided with such angles that the stroke adjustment with respect to the shifting of the pivot point will be as desired. The shifting of the pivot point means that the stroke in different locations of the chamber is changed. In some cases, it is possible to keep the stroke constant in the lower part of the chamber and to adjust it only in the upper part of the chamber, or vice versa. Thus, the location of the pivot point will determine the stroke on the vertical axis in different parts of the chamber.

In one embodiment, the adjusting means for changing the mutual position of the gear transmission of the first bushing and the gear transmission of the second bushing are fitted to change the pivot point of the crusher.

In one embodiment, the crusher comprises an upper bearing for supporting the first crushing blade from above, and the position of the upper bearing can be adjusted parallel to the main shaft.

In one embodiment, the crusher comprises a three-part thrust bearing arrangement at the end of the main shaft.

The different embodiments of the above-described arrangement, taken separately and in various combinations, provide several advantages. A significant advantage provided by one embodiment is the possibility to change the point of intersection between the central line of the main shaft and the central line of the first crushing blade, called the pivot point.

A significant advantage provided by one embodiment is that the kinematics of the chamber of the crusher can be changed by adjusting the stroke of the crushing blade mounted on the main shaft and/or by changing the position of the virtual rotation centre (pivot point) on the central line of the main shaft.

Changing both the stroke and the pivot point provides the crusher with a possibility of adjustment that is much more versatile than before.

In one embodiment, only the location of the pivot point is changed, instead of the stroke. This provides several advantages. For example, by raising the pivot point upwards,

- it is possible to increase the efficiency of the crusher, because the crushing chamber is more effective all the way from above,
- the movement of the upper part of the inner blade (blade of the crushing cone) increases, causing better "setting" of the rocks to be crushed before the crushing,
- bridging of rocks in the crushing chamber is prevented,
- the opening angle becomes smaller, wherein the crushing blades get a better grip on the material to be crushed.

By lowering the pivot point downwards, in turn, it is possible, for example, to adjust the loading level of the crusher (for example, a safety guard to prevent overloading).

By changing the pivot point, it is possible to adjust the stroke in the upper part of the chamber separately from the lower part of the chamber. It is thus possible to change the kinematics of the crushing chamber substantially. By changing the pivot point, among other things,

- it is possible to adjust the distribution of the end product,
- it is possible to affect the shape of a given fraction,
- if there is no more margin for adjustment of the blades, the crushing blades can be used longer than before by increasing the stroke and by changing the pivot point.

DESCRIPTION OF THE DRAWINGS

In the following, the invention will be described in more detail with reference to the appended principle drawings, in which.

For the sake of clarity, the drawings only show the details necessary for understanding the invention. The structures and details that are not necessary for understanding the invention but are obvious for anyone skilled in the art have been omitted from the figures in order to emphasize the characteristics of the invention.

DETAILED DESCRIPTION OF THE INVENTION

Figure 1:
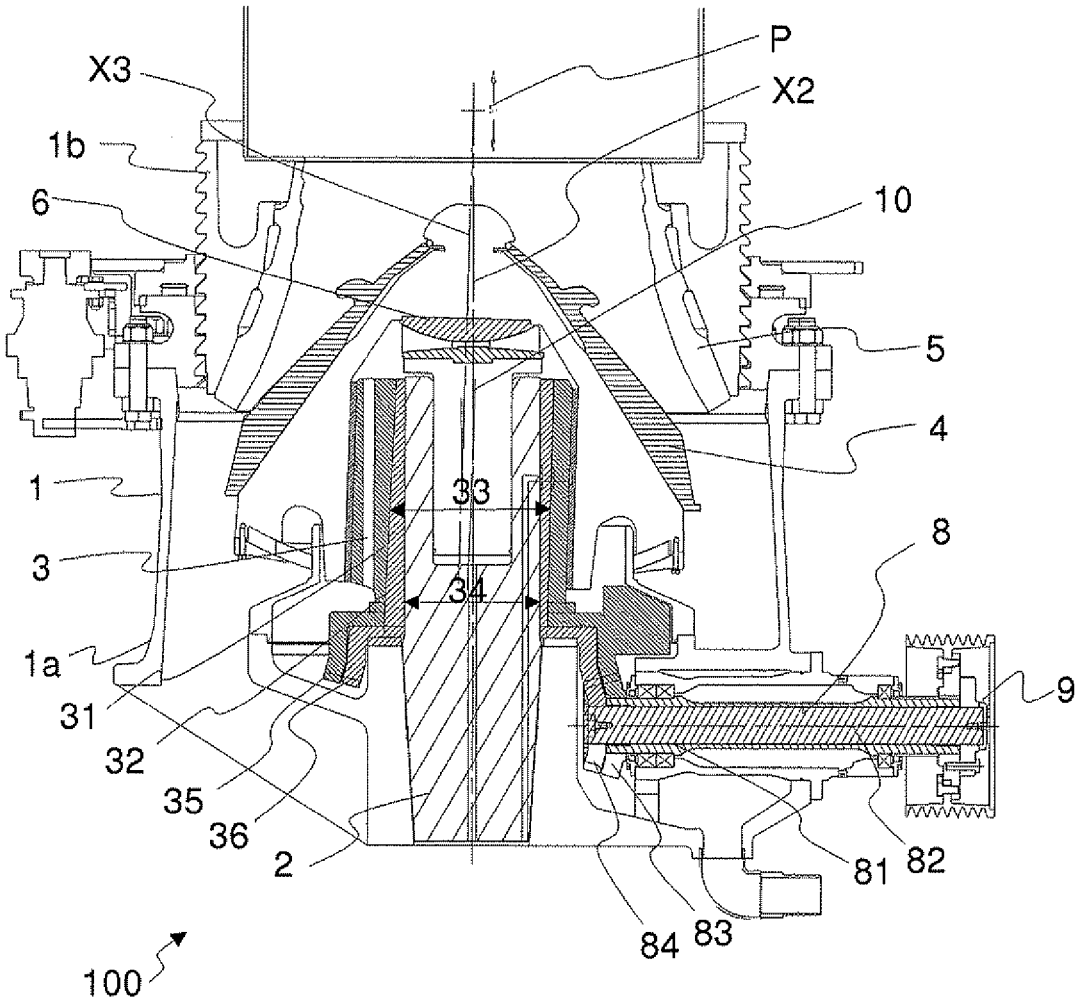
FIG. 1 shows an advantageous embodiment of a crusher.

FIG. 1 shows a very advantageous assembly according to the basic idea of the present invention. The apparatus according to the example comprises a frame 1, a main shaft 2, an eccentric 3 (or an eccentric shaft), a first crushing blade 4, and a second crushing blade 5. In the examples, the first crushing blade 4 and the second crushing blade 5 are primarily conical crushing blades. The frame 1 of the crusher consists of a lower frame 1*a* and an upper frame 1*b*. The main shaft 2 is mounted on the lower frame 1*a* of the crusher.

The eccentric 3 is arranged to be rotatable with respect to the main shaft 2. The main shaft 2 has a central axis X2 and the eccentric 3 has a rotation axis X3. The rotation axis X3 of the eccentric is tilted with respect to the central axis X2 of the main shaft. The location of the rotation centre of the eccentric 3 on the central line X2 of the main shaft, or the intersection between the central line X2 of the main shaft and the rotation axis X3 of the eccentric, that is, the point of intersection between the central line of the main shaft and the central line of the first crushing blade 4, is called a pivot point P. In an advantageous embodiment, the location of the pivot point P can be changed, for example, in a manner to be described below in the description.

In the arrangement according to the invention, the eccentric 3 comprises at least a first bushing 31 and a second bushing 32 around the main shaft 2. The first bushing i.e. the outer eccentric bushing 31 comprises a second hole 33. The second bushing i.e. the inner eccentric bushing 32 is inside the first eccentric bushing 31. The inner eccentric bushing 32 is arranged to be at least partly pivotable in a stepless manner in said second hole 33. The inner eccentric bushing 32, in turn, comprises a hole, i.e. a main shaft hole 34, in which the main shaft is placed at least partly. Furthermore, the outer eccentric bushing 31 comprises a gear transmission 35 for rotating the eccentric 3 around the main shaft 2. The periphery of the eccentric 3, i.e. the periphery of the outer eccentric bushing 31, is placed eccentrically around the main shaft 2. Furthermore, between the eccentric 3 and the main shaft 2, structures enabling a movement are provided, such as bearings and/or sliding surfaces, which may be integrated with the eccentric and/or the main shaft.

The first crushing blade 4 is connected to the eccentric 3 in such a way that the eccentric produces the movement of the first crushing blade. Preferably, the first crushing blade 4 is connected to the eccentric 3 by means of a suitable structure, such as a supporting cone. The first crushing blade 4 mounted to the eccentric 3 can be rotated with respect to the second crushing blade 5 in such a way that a forced swinging movement or stroke is produced between the first crushing blade and the second crushing blade. The first crushing blade 4 is arranged to move along an eccentric path around the axial tine X2 of the main shaft. During a cycle, the main shaft hole 34 of the eccentric 3, in which the main shaft 2 is, causes a forced swinging movement of the first crushing blade 4, which reduces and increases the gap between the first crushing blade and the second crushing blade 5, effecting the crushing of the material to be crushed. The path can be adjusted by changing the mutual position between the first eccentric bushing 31 and the second eccentric bushing 32 of the eccentric 3.

By turning the inner eccentric bushing 32 in the second hole 33, it is possible to change the position of the central axis X2 of the main shaft 2 with respect to the periphery of the eccentric 3 to change the length of said forced swinging movement. This is because the mutual position between the central axis of the main shaft hole 34 and the rotation axis X3 of the eccentric is changed. If the central axis of the main shaft hole 34 is on the rotation axis X3 of the eccentric, the central axis X2 of the main shaft is in the same location as the rotation axis X3 of the eccentric, wherein there is no stroke. If the rotation axis X3 of the eccentric is moved farther away from the rotation axis X2 of the main shaft 2, the stroke is increased. At the same time, the inclination of the rotation axis X3 of the eccentric with respect to the central axis X2 is changed.

Figure 2:
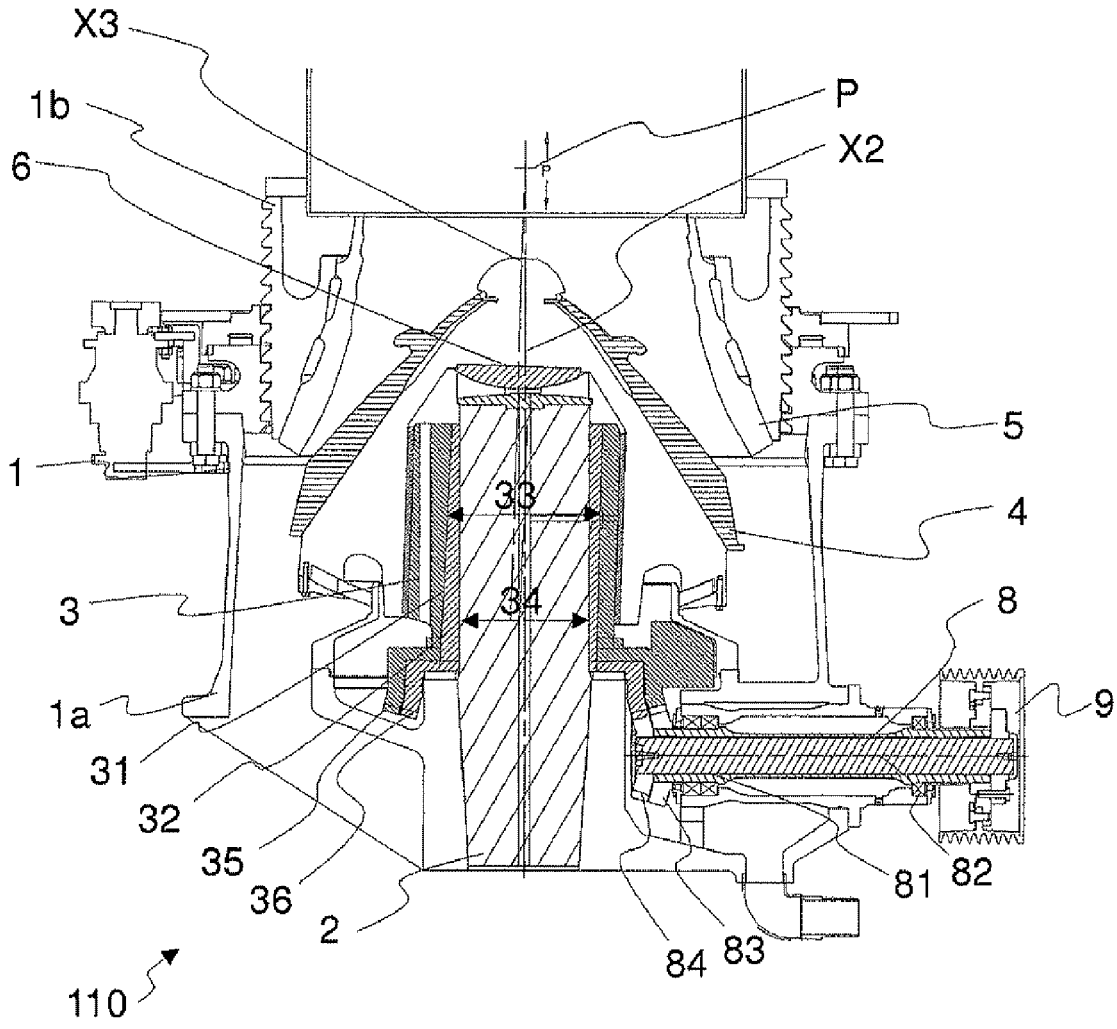
FIGS. 2 to 4 show some embodiments of a crusher.
Figure 3:
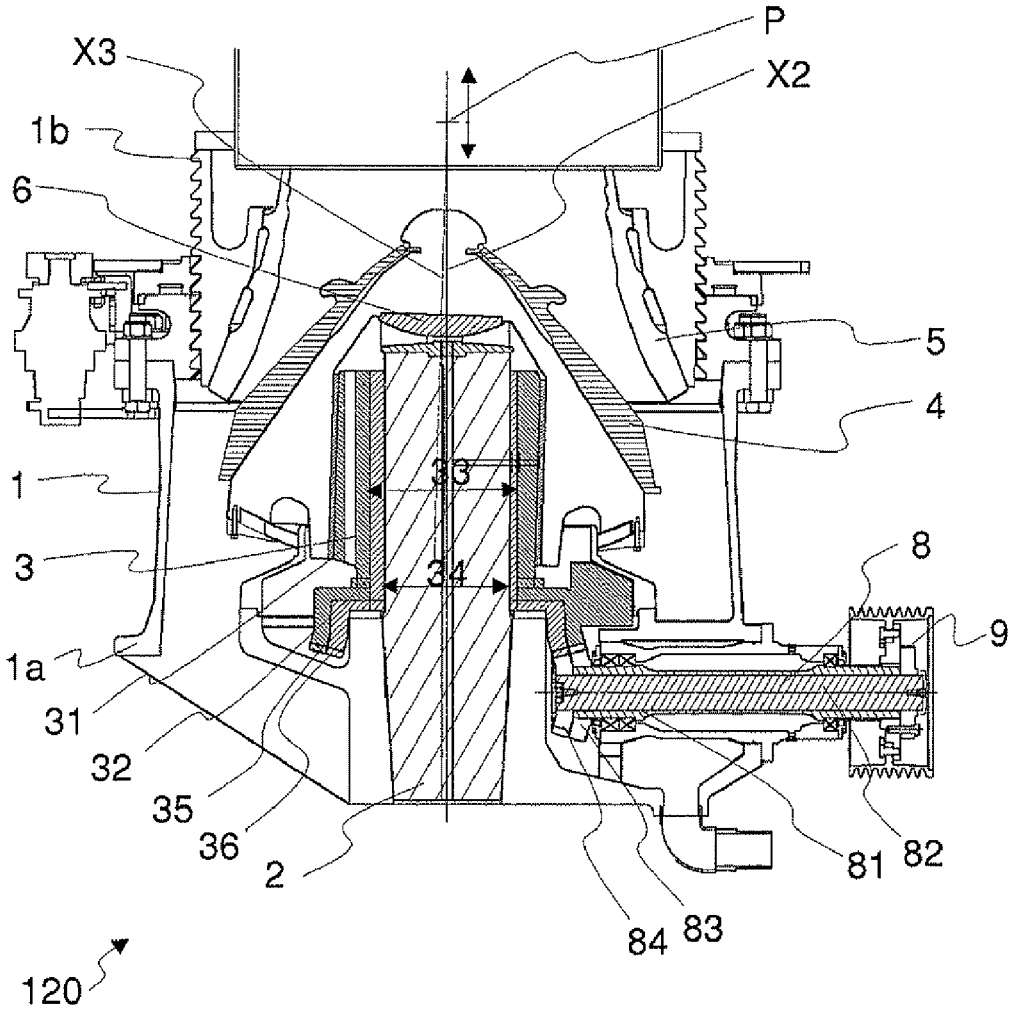

FIGS. 2 and 3 show a cone crusher with a main shaft 2 placed in the main shaft hole 34 of a rotatable eccentric 3. The walls of the main shaft hole 34 are symmetrically around the central line of the main shaft, and preferably the walls are parallel to the central line of the main shaft. The second hole 33, in turn, may be inclined, as shown in FIG. 2, or upright, as shown in FIG. 3. In this context, an inclined hole refers to a hole in which the walls of the hole are divergent from the walls of the main shaft hole 34. In other words, in the inclined second hole 33, the walls are not parallel to the central line X2 of the main shaft. By the direction of the walls of the second hole 33, it is possible to affect the adjustment properties. Advantageously, the eccentric 3 comprises an inclined second hole 33, as shown in the examples of FIGS. 1 and 2.

In the embodiments with an inclined second hole 33, shown in FIGS. 1 and 2, it is possible to affect the tilting of the rotation axis X3 of the eccentric. Furthermore, it is possible to affect the position of the intersection (pivot point P) between the central line X2 of the main shaft and the central line X3 of the first crushing blade.

Figure 6:
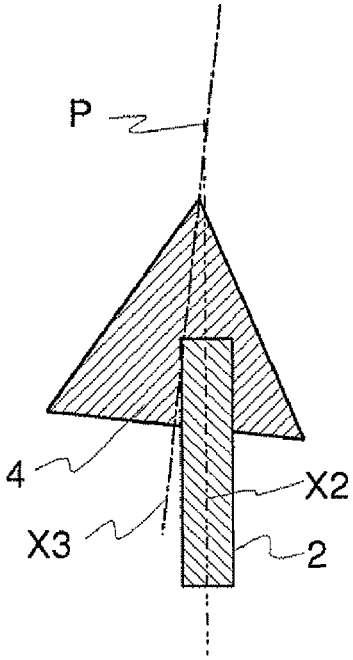
FIGS. 6 to 8 show the position of axial lines of the main shaft and the first crushing blade in different situations.
Figure 7:
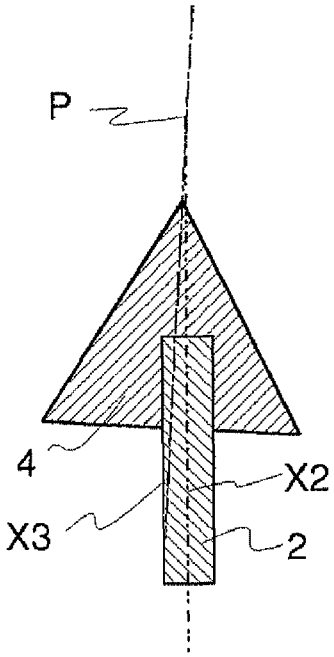
Figure 8:
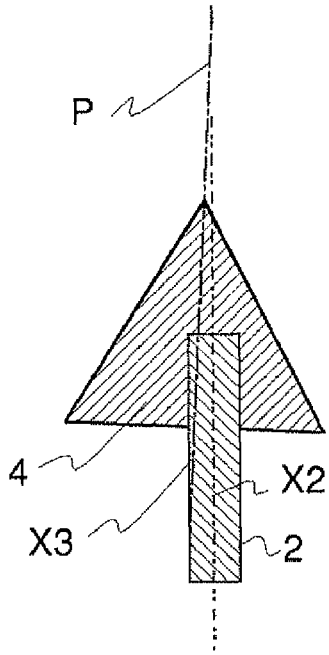

In the solution of FIG. 3, in turn, the second hole 33 is upright. In the example shown in the figure (as also in the examples of FIGS. 1 and 2), the crusher comprises a three-part thrust bearing arrangement 6 at the end of the main shaft 2. Said bearing arrangement 6 makes it possible to change the position of the first crushing blade 4 with respect to the main shaft 2 so that the point of intersection P between the central line X2 of the main shaft and the central line X3 of the first crushing blade can be changed. The bearing arrangement 6 makes it possible to tilt the first crushing blade 4 with respect to the central line X2 of the main shaft. Preferably, the bearing arrangement 6 makes it possible to move the position of the first crushing blade 4 along a line perpendicular to the central tine X2 of the main shaft. FIGS. 6, 7 and 8 show the positions of the axial lines X2, X3 of the main shaft 2 and the first crushing blade 4 in different situations. If the position of FIG. 6 is considered the initial position, then in FIG. 7, the position of the first crushing blade 4 has been changed so that the pivot point P has remained unaltered. In FIG. 8, in turn, the position of the crushing blade 4 has been changed so that the pivot point P has ascended.

Figure 4:
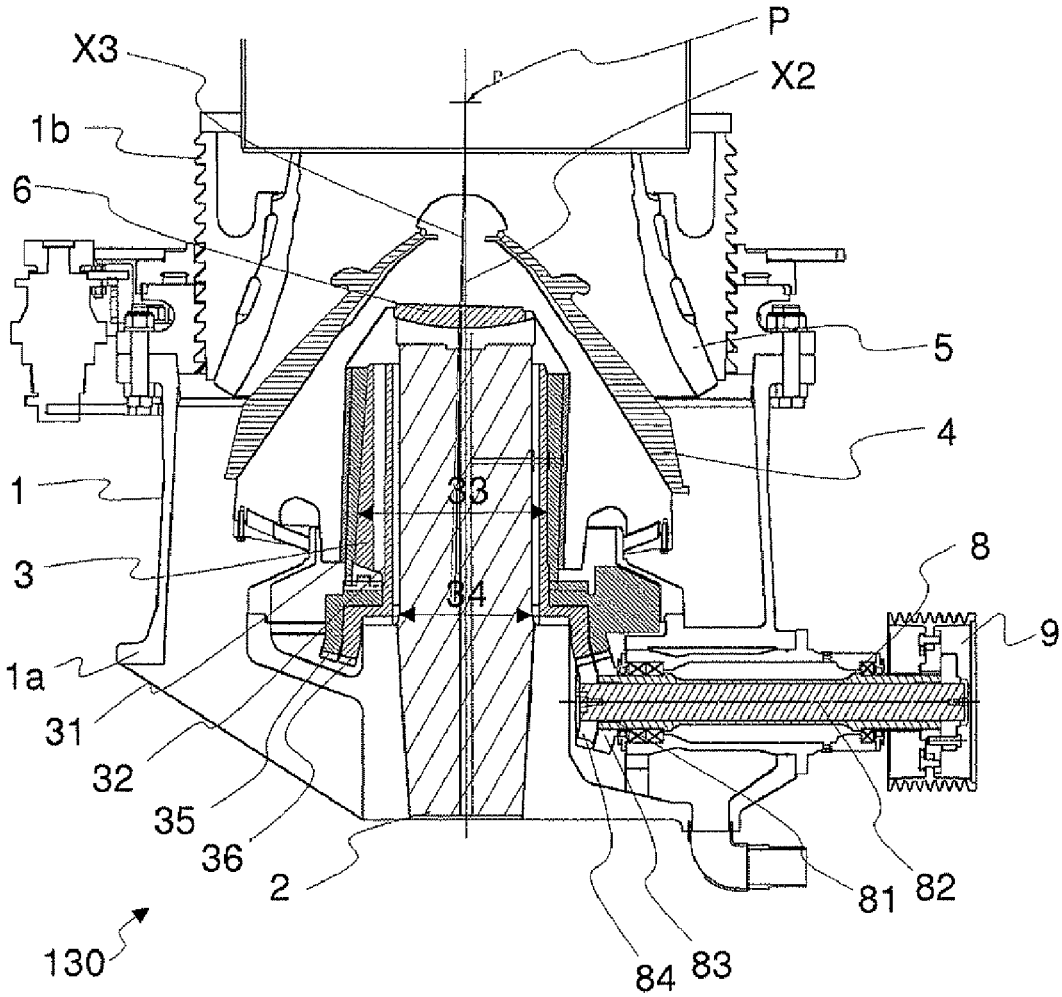

In the embodiment of FIG. 4, the second hole 33 is upright in the same way as in the embodiment of FIG. 3. In the example of FIG. 4, the crusher comprises a conventional two-part thrust bearing arrangement 6 at the end of the main shaft 2. Said bearing arrangement 6 makes it possible to change the position of the first crushing blade 4 with respect to the main shaft 2 so that the point of intersection P (pivot point P) between the central line of the main shaft and the central line of the first crushing blade remains substantially constant. The bearing arrangement 6 of FIG. 4 makes it possible to tilt the first crushing blade 4 with respect to the central line X2 of the main shaft.

Figure 5:
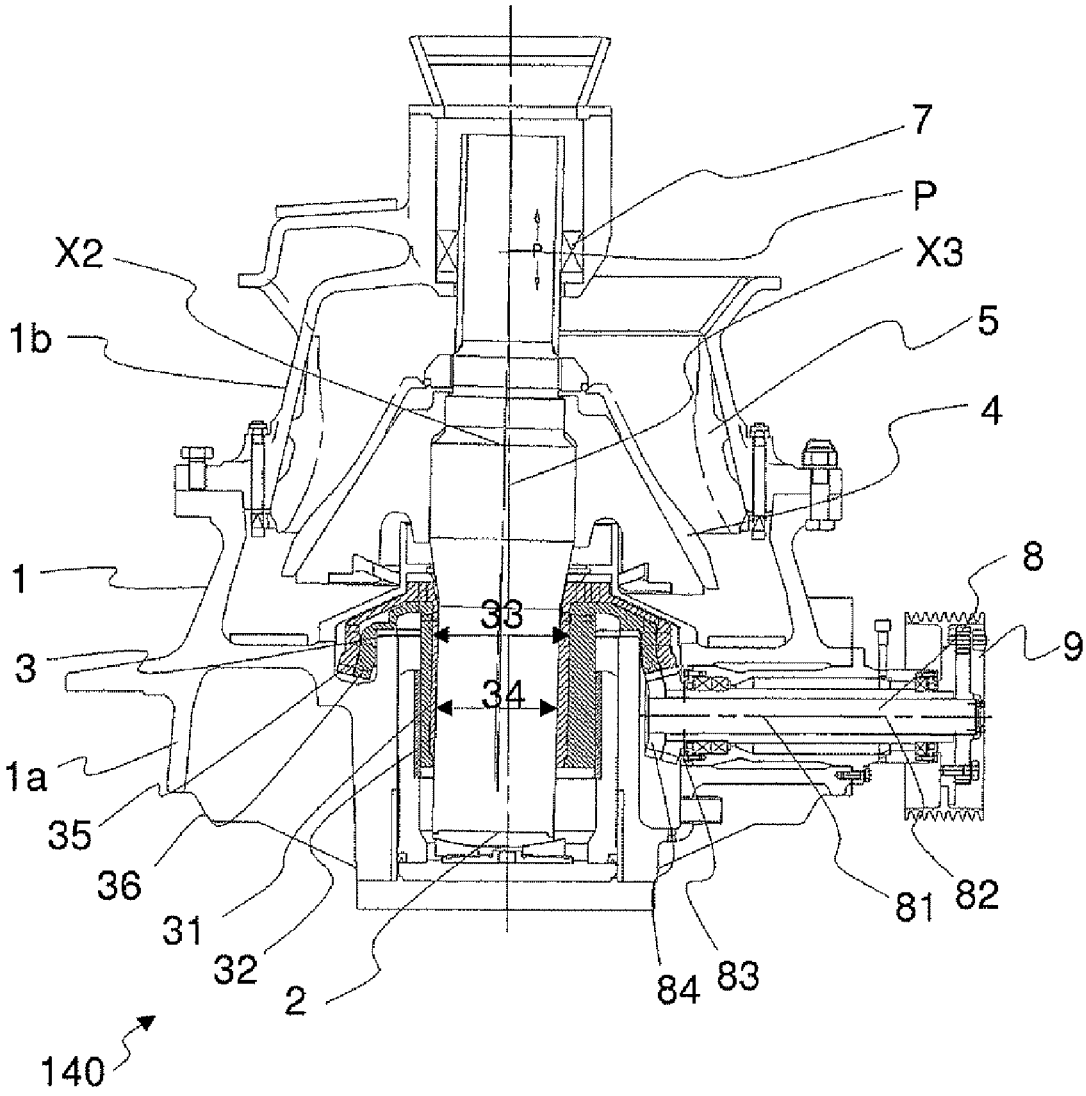
FIG. 5 shows an embodiment of a crusher equipped with an upper thrust bearing.

FIG. 5 shows an embodiment, in which the crusher comprises an upper bearing 7 for supporting the first crushing blade 4 from above. In the example, the position of the upper bearing 7 can be adjusted parallel to the central tine X3. Thus, for changing the position of the first crushing blade 4 with respect to the central line X3 to change the point of intersection between the central line X2 of the main shaft and the central line X3 of the second crushing blade 5, the position of the upper bearing 7 is changed. Preferably, the position of the upper bearing 7 is at the pivot point P.

In the above examples, also the second eccentric bushing 32 comprises a gear transmission 36 which can be used to rotate the eccentric 3. Furthermore, the crusher comprises means for changing the mutual position between the gear transmission 35 of the first eccentric bushing 31 and the gear transmission 36 of the second eccentric bushing 32 and thereby for adjusting the eccentric path of the eccentric 3. The crusher comprises preferably adjusting means 8 and an adjusting unit 9 for adjusting the gear transmissions 35, 36. In the example, the adjusting means 8 consist of an adjusting shaft 81 and a drive shaft 82. The adjusting shaft comprises a first drive gear 82 (adjusting gear) arranged to engage the gear transmission 35 of the first eccentric bushing 31. The drive shaft 82, in turn, comprises a second drive gear 84 arranged to engage the gear transmission 36 of the second eccentric bushing 32. In the figures, the inner gear 36 is a conical gear and the outer gear 36 is a conical gear, and they constitute a pair of conical gears. In the figures, the adjusting gear 83 and the second drive gear 84 also constitute a pair of conical gears. In the figures, the first and second drive gears 83, 84 are arranged substantially concentrically.

In the solutions shown in the Figures, the adjusting gear 83 is mounted on the adjusting shaft 81 which is hollow, and the second drive gear 84 is mounted on the drive shaft 82 which is at least partly in the adjusting shaft. The adjusting shaft 81 and the drive shaft 82 are substantially coaxial. In the figures, a drive pulley is mounted on the adjusting shaft 81 and locked by the adjusting unit 9 to the drive shaft 82 so that during crushing, both shafts 81 and 82 transmit the rotating motion in the same phase to the eccentric 3. Alternatively, the adjusting shaft 81 and the drive shaft 82 can be rotated in another way. By means of the drive shaft 82 and the adjusting shaft 81, the rotation force is transmitted to the eccentric 3.

The crusher comprises the above-described gear transmission for turning the inner eccentric bushing 32 in said second hole 33 so that the position of the main shaft hole 34 of the eccentric 3 with respect to the periphery of the eccentric is changed, resulting in a change in the magnitude of the forced stroke. This gear transmission is preferably also fitted to keep the inner eccentric bushing 32 stationary in a non-rotating manner in the second hole 33.

The crusher also comprises an adjusting unit 9, by means of which it is possible to change the rotational relationship between the adjusting gear 83 and the second drive gear 84 or between the adjusting shaft 81 and the drive shaft 82 to change the stroke and/or the position of the pivot point. In advantageous embodiments, the rotational relationship between the adjusting gear 83 and the second drive gear 84 can be adjusted when the crusher is either in operation (with or without a load) or stopped. The adjusting unit 9 can be implemented in a number of ways, and some advantageous ways will be presented hereinbelow.

In one adjusting unit embodiment, a drive belt pulley is provided with an actuator, for example a hydraulic or electric engine, to drive the gears or chains rotating the adjusting shaft 81 either directly or, for example, by means of a planetary gear. The actuator is preferably equipped with either an integrated or an external brake for the purpose of preventing an unintentional rotation of the adjusting shaft 81 with respect to the drive shaft 82.

In another adjusting unit embodiment, a belt pulley is provided with a worm gear arranged to cooperate with the adjusting shaft 81 so that the adjusting shaft can be rotated by means of the worm gear. The worm gear may comprise, for example, a worm driven by an actuator, preferably a small electric or hydraulic engine. Several such worm gears may be provided to rotate the adjusting shaft 81 simultaneously.

In another adjusting unit embodiment, a drive pulley is equipped with an actuator which is preferably a small electric or hydraulic engine arranged to cooperate with a gear. The gear, in turn, is arranged to cooperate with another gear mounted on the adjusting shaft 81 in such a way that the adjusting shaft 81 can be swiveled by means of the actuator.

Another adjusting embodiment differs from those presented above in that the adjusting power introduced from the outside of the crusher for rotating the adjusting shaft 81 is linear. For this purpose, the adjusting shaft 81 is provided with an inner spiral grooving. When an adjusting rod is pulled and pushed in the groove of the drive shaft 82, a slide fixed to the adjusting rod slides in the spiral groove of the adjusting shaft 81 and thus forces the adjusting shaft to rotate. The adjusting power can be generated, for example, by means of a hydraulic or pneumatic cylinder or an electric cylinder rotating with the adjusting shaft 81.

In another adjusting arrangement, the adjusting power introduced from the outside of the crusher for rotating the adjusting shaft 81 is also linear. For this purpose, the adjusting shaft 81 is provided with an inner spiral grooving. When an adjusting bushing is pulled and pushed, a slide fixed to the adjusting bushing slides in the spiral groove of the adjusting shaft 81 and thus forces the adjusting shaft to rotate. The adjusting power can be generated, for example, by means of a hydraulic or pneumatic cylinder mounted on bearings in the adjusting bushing and in the drive pulley, and connected to the frame 1 of the crusher by a fastening means so that the cylinder does not rotate when the crusher is in operation.

In one adjusting unit solution, the adjusting shaft 81 is turned by means of a separate drive pulley that can be synchronized with the drive pulley of the drive shaft 82. These drive pulleys can be mounted either on the same shaft or on different shafts. The mutual speed of the drive shaft 82 and the adjusting shaft 81 (the stroke of the crusher) is changed by rotating said drive pulleys at different speeds. The speed of the drive pulleys can be synchronized to be the same when the stroke is not changed.

In another adjusting unit embodiment, the gear is turned when the crusher is at rest. The adjusting shaft 81 is rotated, for example, manually or by means of a crank, and it is locked, for example, by means of bolts installed in different holes. Instead of a bolt it is also possible to use a brake mechanism or the like to lock the drive shaft 82 and the adjusting shaft 81 with respect to each other.

The crusher is preferably equipped with an indicator of the rotation angle, for example with a stepper motor. This rotation angle indicator is arranged to measure the rotation angle between the inner eccentric bushing 32 and the outer eccentric bushing 31 directly or by monitoring the mutual position of the means adjusting the rotation angle between the inner eccentric bushing and the outer eccentric bushing, i.e. the mutual position of the parts of the rotating mechanism or gear transmission.

Preferably, the crusher also comprises a hydraulic control device 10 for changing the smallest value of the gap between the first crushing blade 4 and the second crushing blade 5, i.e. for adjusting the setting of the crusher, as shown, for example, in FIG. 1. The setting is changed by means of the hydraulic control device 10 by introducing pressurized medium into a space below a control piston, wherein the first crushing blade 4 rises upwards, reducing the setting, in a corresponding manner, by discharging pressurized medium from the space, the first crushing blade 4 drops downwards, and the setting is increased.

The above-presented solution is suitable for use in different types of crushing plants. For example, the crushing plant may be stationary, wherein the crushing plant cannot be easily transferred from one place to another, but the material to be crushed, such as rock material, is brought the crusher plant and, accordingly, the crushed material, such as chips, is carried away. This solution is also suitable for use in movable crushing plants.

Figure 9:
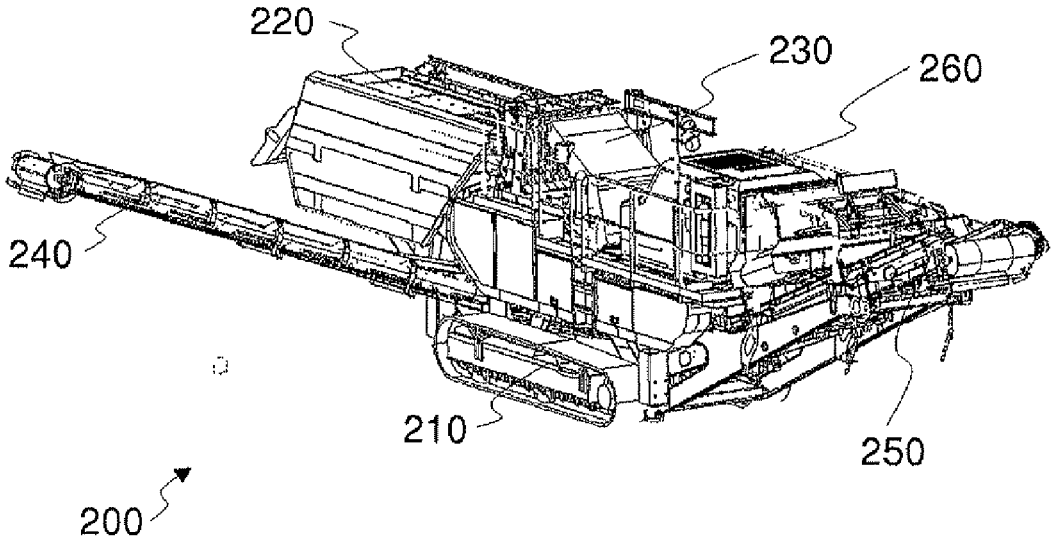
FIG. 9 shows a movable crushing plant.

FIG. 9 shows a movable crushing plant 200 comprising means 210 for moving the crushing plant, which means may be, for example, tracks, legs, or wheels. Furthermore, the crushing plant 200 comprises means 220 for feeding the material to be crushed, for example mineral material, into a crusher 230, which is preferably a crusher 100-140 according to one embodiment of the invention. Similarly, the crushing plant 200 advantageously also comprises means 240, 250 for transporting the crushed material away from the direct vicinity of the crusher 230. In FIG. 9, belt conveyors are used as a side conveyor 240 and a main conveyor 250. The crushing plant 200 also comprises a power source 260, such as a diesel engine for driving the actuators and moving the plant.

Figure 10:
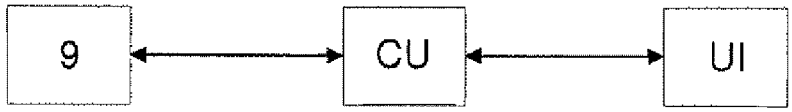
FIG. 10 is a block chart showing a control system.

FIG. 10 shows a control system for a crusher according to the invention, which may comprise a user interface UI, a control unit CU, and an adjusting unit 9. By means of the user interface UI, the user may enter the control data, such as setting data. The user interface UI may be connected to the crusher or be separate from the crusher, wherein the data transmission between the user interface UI and the control unit CU can be implemented, for example, by means of a cable or in a wireless manner by radio communication.

Figure 11:
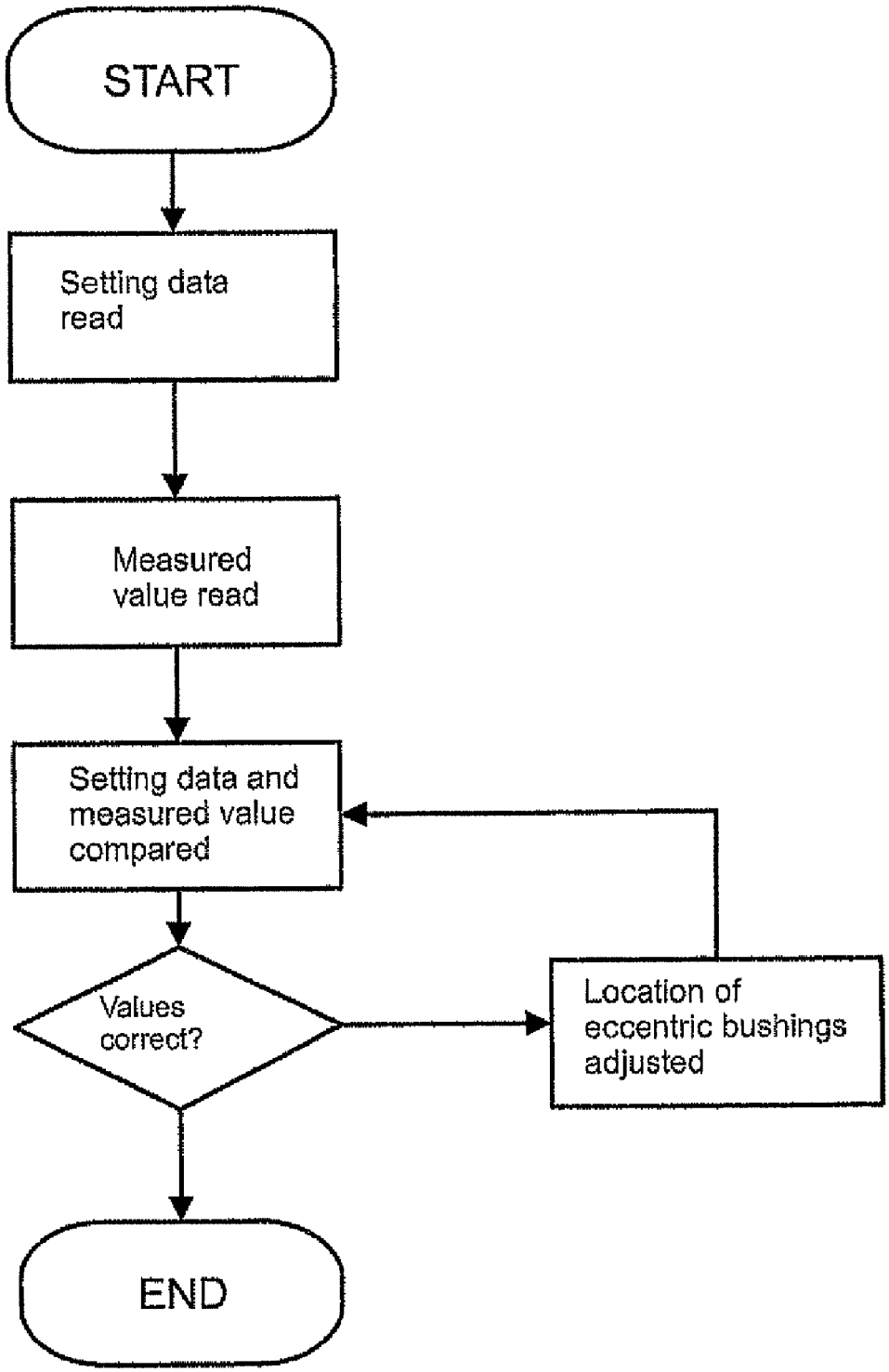
FIG. 11 is a flow chart showing an adjustment operation.

In one embodiment, the control unit CU reads the setting data from the user interface UI and compares them with the values of the adjusting unit 9. If the values do not match each other within allowed limits, the control unit CU gives the adjusting unit 9 a control command. The reading of values and the giving of control commands is preferably repeated so many times that the values match each other within the limits of allowable deviations. One such adjustment operation is shown in the flow chart of FIG. 11. The adjustment method of the crusher according to the invention is implemented preferably by means of a computer program.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims hereinbelow.

The invention claimed is:

1. A crusher comprising at least a main shaft having an axial line and fitted in the lower frame of the crusher, a eccentric comprising at least a first eccentric bushing and a second eccentric bushing around the main shaft, of which the second eccentric bushing is inside the first eccentric bushing, and of which the first eccentric bushing comprises a gear transmission for rotating the eccentric, a first crushing blade, and a second crushing blade, of which the first crushing blade is fitted to move along an eccentric path, which path can be adjusted by changing the mutual position of the first eccentric bushing and the second eccentric bushing of the eccentric, wherein the second eccentric bushing comprises a gear transmission for rotating the eccentric, and the crusher comprises adjusting means for changing the mutual position of the gear transmission of the first eccentric bushing and the gear transmission of the second eccentric bushing and thereby for adjusting the eccentric path of the eccentric and that the eccentric shaft is fitted at least partly in to the first crushing blade.

2. The crusher according to claim 1, wherein the first eccentric bushing comprises a hole and the second eccentric bushing comprises a hole, and the main shaft is fitted in the hole of the second eccentric bushing.

3. The crusher according to claim 2, wherein the direction of the hole in the first eccentric bushing is different from the direction of the axial line of the main shaft.

4. The crusher according to claim 2, wherein the hole in the first eccentric bushing is parallel to the direction of the axial line of the main shaft.

5. The crusher according to claim 1, wherein the adjusting means for changing the mutual position of the gear transmission of the first eccentric bushing and the gear transmission of the second eccentric bushing are arranged to change the pivot point of the crusher.

6. The crusher according to claim 1, wherein the crusher comprises an upper bearing for supporting the first crushing blade from above, and the position of the upper bearing is adjustable along the axial line.

7. The crusher according to claim 1, wherein the crusher comprises a three-part thrust bearing arrangement at the end of the main shaft.

8. A crushing plant comprising a crusher and means for feeding material to be crushed into the crusher, the crusher comprising at least a main shaft having an axial line and being fitted in the lower frame of the crusher, a eccentric comprising at least a first eccentric bushing and a second eccentric bushing around the main shaft, of which the second eccentric bushing is inside the first eccentric bushing, and of which the first eccentric bushing comprises a gear transmission for rotating the eccentric, a first crushing blade, and a second crushing blade, of which the first crushing blade is fitted to move along an eccentric path, which path can be adjusted by changing the mutual position of the first eccentric bushing and the second eccentric bushing of the eccentric, wherein the second eccentric bushing comprises a gear transmission for rotating the eccentric, and the crusher comprises adjusting means for changing the mutual position of the gear transmission of the first eccentric bushing and the gear transmission of the second eccentric bushing and thereby for adjusting the eccentric path of the eccentric and that the eccentric shaft is fitted at least partly in to the first crushing blade.

9. The crushing plant according to claim 8, wherein the crushing plant is stationary.

10. The crushing plant according to claim 8, wherein the crushing plant comprises means for moving the crushing plant.

11. A method for adjusting the stroke of a crusher, the crusher comprising at least a main shaft having an axial line, which main shaft is fitted in the lower frame of the crusher, a eccentric comprising at least a first eccentric bushing and a second eccentric bushing around the main shaft, of which the second eccentric bushing is inside the first eccentric bushing, and of which the first eccentric bushing comprises a gear transmission for rotating the eccentric, a first crushing blade having a central line, and a second crushing blade, of which the first crushing blade is moved along an eccentric path, which path is adjusted by changing the mutual position of the first eccentric bushing and the second eccentric bushing of the eccentric, wherein the eccentric is rotated by a gear transmission being in connection with the second eccentric bushing, and that the stroke of the crusher is adjusted by changing the mutual position of the gear transmission of the first eccentric bushing and the gear transmission of the second eccentric bushing and that eccentric shaft is rotated at least partly in the first crushing blade.

12. The method according to claim 11, wherein the mutual position of the gear transmission of the first eccentric bushing and the gear transmission of the second eccentric bushing are changed to change the position of the point of intersection between the central line of the main shaft and the central line of the first crushing blade.

13. The method according to claim 11, wherein the first crushing blade is supported from above by an upper bearing being provided with the crusher, and that the position of the upper bearing is adjusted in parallel with the axial line when the point of intersection between the central line of the first crushing blade and the main shaft, and the central line of the second crushing blade is changed.

* * * * *